US007530839B1

(12) United States Patent
Lee

(10) Patent No.: US 7,530,839 B1
(45) Date of Patent: May 12, 2009

(54) ELECTRICAL CONNECTOR

(75) Inventor: Wen-Lung Lee, Taipei (TW)

(73) Assignee: Jess-Link Products Co., Ltd., Taipei County (TW)

( * ) Notice: Subject to any disclaimer, the term of this patent is extended or adjusted under 35 U.S.C. 154(b) by 0 days.

(21) Appl. No.: 12/081,324

(22) Filed: Apr. 15, 2008

(51) Int. Cl.
*H01R 12/24* (2006.01)

(52) U.S. Cl. ..... 439/496; 439/497

(58) Field of Classification Search ..... 439/492, 439/496, 497, 499
See application file for complete search history.

(56) References Cited

U.S. PATENT DOCUMENTS

| | | | | |
|---|---|---|---|---|
| 4,749,371 | A * | 6/1988 | Hirai et al. | 439/497 |
| 6,066,000 | A * | 5/2000 | Masumoto et al. | 439/607 |
| 6,165,007 | A * | 12/2000 | Higuchi et al. | 439/492 |
| 6,217,344 | B1 * | 4/2001 | Saito et al. | 439/67 |
| 6,626,698 | B2 * | 9/2003 | Matsumura | 439/496 |
| 6,755,683 | B2 * | 6/2004 | Roberts et al. | 439/496 |
| 7,070,444 | B2 * | 7/2006 | Sato et al. | 439/496 |
| 7,114,988 | B2 * | 10/2006 | Sato et al. | 439/492 |
| 7,204,707 | B2 * | 4/2007 | Kawase et al. | 439/247 |
| 7,232,334 | B2 * | 6/2007 | Shimizu et al. | 439/496 |
| 2002/0142647 | A1 * | 10/2002 | Aoki | 439/496 |
| 2004/0235339 | A1 * | 11/2004 | Sato et al. | 439/492 |
| 2005/0153595 | A1 * | 7/2005 | Fuerst et al. | 439/496 |
| 2006/0019529 | A1 * | 1/2006 | Ko | 439/497 |
| 2006/0252300 | A1 * | 11/2006 | Sato et al. | 439/492 |
| 2007/0010124 | A1 * | 1/2007 | Ko | 439/492 |
| 2008/0305678 | A1 * | 12/2008 | Chiang | 439/492 |

FOREIGN PATENT DOCUMENTS

| | | |
|---|---|---|
| TW | M249255 | 11/2004 |

* cited by examiner

*Primary Examiner*—Ross N Gushi
(74) *Attorney, Agent, or Firm*—Rosenberg, Klein & Lee

(57) ABSTRACT

An electrical connector includes an insulating body, an inner flexible plug, two metal housings and a flexible cable. The insulating body includes a base, two side portions set on two opposite sides of said base respectively and a top board connected between the side portions. A plurality of terminal grooves is defined in the base. The inner flexible plug is combined in the insulating body. The metal housings cover the insulating body. The flexible cable is set between the insulating body and the inner flexible plug. The inner flexible plug defines a plurality of receiving slots corresponding to the terminal grooves. The receiving slots extend from top side of the inner flexible plug to its bottom side in a bent way thus the flexible cable can be electrically connected with electrical connecting terminals set in the terminal grooves. Therefore, the electrical connector is easily assembled and has a stable structure.

10 Claims, 11 Drawing Sheets

ELECTRICAL CONNECTOR

BACKGROUND OF THE INVENTION

1. Field of the Invention

The present invention relates to an electrical connector, and more particular to an electrical connector which is combined with a flexible cable of which metal conducting wires are electrically connected with electrical connecting terminals of the electrical connector correspondingly.

2. Description of Related Art

Electrical connectors are combined in many electronic products to switch or relay signals or power supplies. Recently, flexible cables have been produced to meet the need of spatial allocation and circuit connection inside the electronic products. Flexible cables are also often combined with electrical connectors to yield optimal performance.

A conventional electrical connector includes an insulating body, a plurality of terminals and a flexible cable. The plurality of terminals is inserted on the insulating body with an interval between every two adjacent terminals. The flexible cable is welded onto the ends of the plurality of terminals. The terminals of the electrical connector are used to be connected with an abutment connector. An electrical connection is formed by contacting the terminals of the electrical connector with the terminals of the abutment connector, and signals can be transmitted by the flexible cable.

However, the electrical connector of the prior art has shortcomings as follow:

1. The plurality of terminals must be assembled in the pre-setting terminal slots of the insulating body one by one, and then welded with the corresponding flexible cable respectively. Thus, the assembly is complex as many components are needed in the electrical connector.
2. After being removed the insulating sheath, the flexible cable needs to be combined with a strengthen board by adhesion to improve strength and stability, thereby keeping the flexible cable from dislocating under external force during the welding.
3. It is difficult to weld the flexible cable and the terminals together, and the work time is long, thus, the defective rate of products is higher.

For example, TW patent NO. M249255 discloses an electrical connector, which includes a metal housing and an insulating body. A strengthen wall and a "T" shaped slot are defined on the metal housing, correspondingly, a block arm and a protrusion are defined on the insulating body. The terminals and the flexible cable are fastened together to overcome the shortage of the welding method and make the assembly of the electrical connector and the flexible cable easier. However, there still exist the questions such as the flexible cable cannot be properly located, and the asymmetric force occurs after fastening, which lead the flexible cable to be inserted onto a wrong location or incline to one side, thus, bad contact and short circuit may occur.

Consequently, because of the technical defects of described above, the applicant keeps on carving unflaggingly through wholehearted experience and research to develop the present invention, which can effectively improve the defects described above.

SUMMARY OF THE INVENTION

The object of the present invention is to provide an electrical connector which makes an insulating body, an inner flexible plug and a flexible cable be combined one another to shorten work time and increase yield rate.

For achieving the object described above, the present invention provides an electrical connector. The electrical connector includes an insulating body. The insulating body includes a base, two side portions, and a top board. The two side portions are respectively set on two opposite sides of the base, the top board is connected between the side portions, and a plurality of terminal grooves are defined in a front end of the base. An inner flexible plug is combined in the insulating body, and a plurality of receiving slots is defined in the inner flexible plug to correspond to the terminal grooves. The plurality of receiving slots is separated by a plurality of separating ribs. The plurality of separating ribs and the plurality of receiving slots extend from top side of the inner flexible plug to its bottom side in a bent manner. A metal housing covers the bottom of the insulating body. A flexible cable is set between the insulating body and the inner flexible plug. A curved segment is defined on a middle segment of the flexible cable and is set in the plurality of receiving slots.

The advantageous of the present invention are: the flexible cable and the electrical connecting terminals can be properly located and connected because of the inner flexible plug, thus, any weld processes aren't needed. Furthermore, because the flexible cable can be easily manufactured and the insulating body can be conveniently assembled, the work time is shortened and the yield rate is increased. The flexible cable can be closely combined by the force occurred between the inner flexible plug and the insulating body, thus, the problem of the asymmetric force and the cases of miss locating or inclining which make the circuitry badly contact and short circuit can be avoided.

The features and technology of the present invention can be further understood by reference to the detailed description which follows taken in conjunction with the accompanying drawings, and the accompanying drawings are provided only for reference and explain and not as limiting the present invention.

DETAILED DESCRIPTION OF THE PREFERRED EMBODIMENTS

Figure 1:
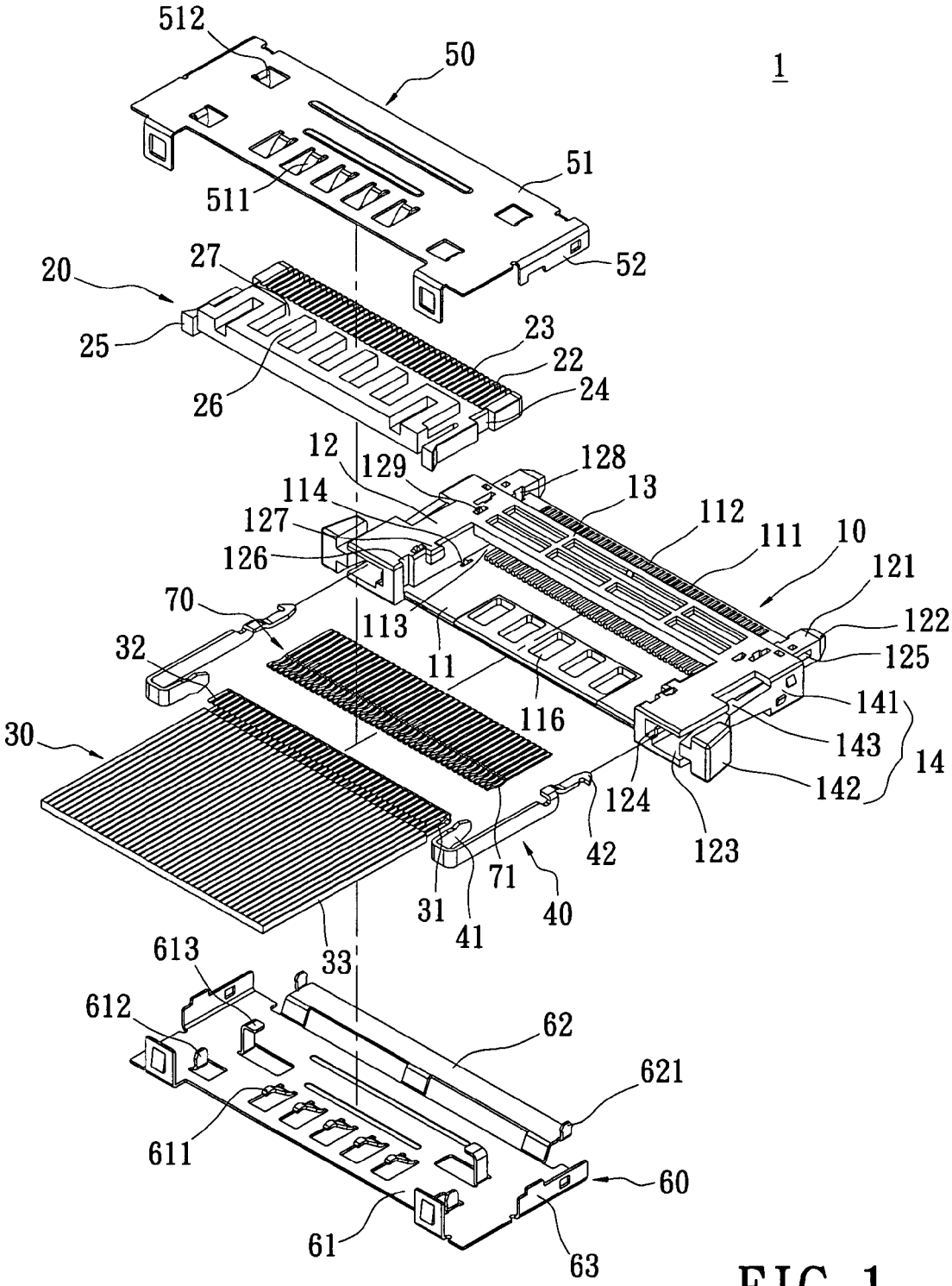
FIG. 1 is an exploded perspective view showing an electrical connector according to the present invention.

Please refer to FIG. 1, an electrical connector 1 of the present invention includes an insulating body 10, an inner flexible plug 20, a flexible cable 30, two hook portions 40, a first metal housing 50, a second metal housing 60, and a plurality of electrical connecting terminals 70.

Figure 2B:
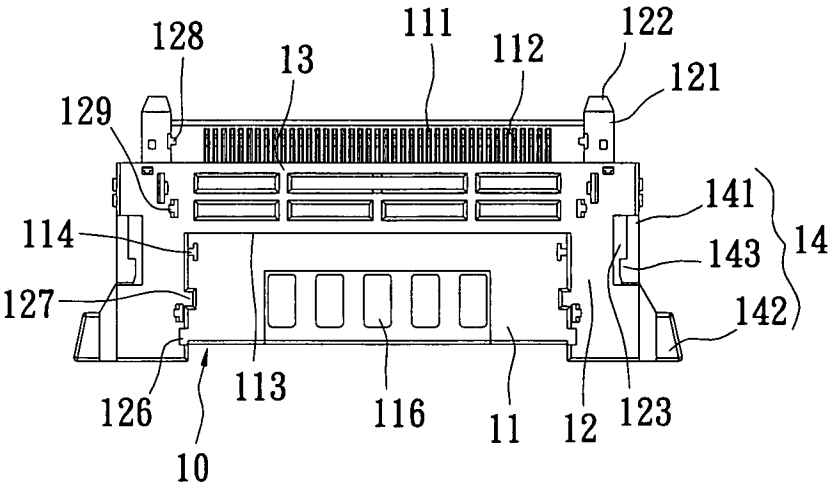
FIG. 2B is a top view showing the insulating body according to the present invention.
Figure 2C:
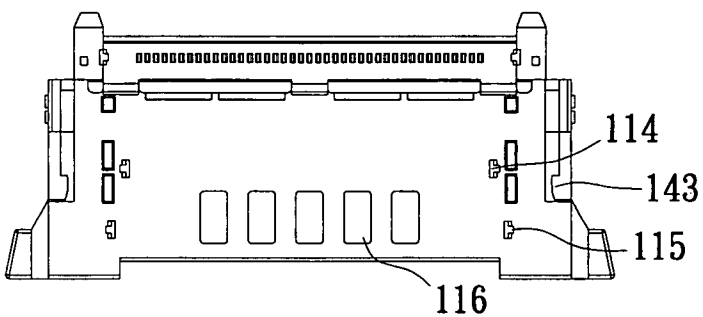
FIG. 2C is a bottom view showing the insulating body according to the present invention.
Figure 2A:
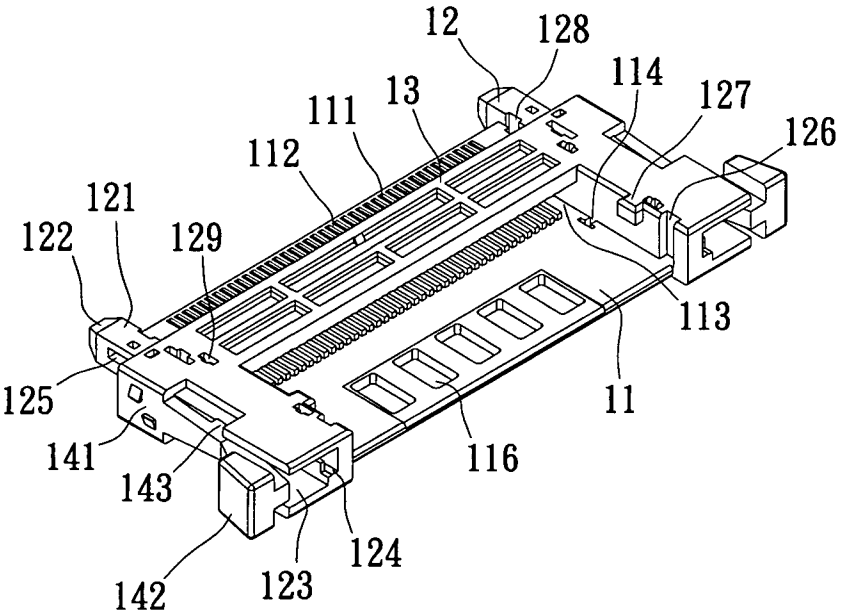
FIG. 2A is a perspective view showing an insulating body according to the present invention.

Please refer to FIGS. 2A-2C corporately, the insulating body 10 is made of insulating plastic and includes a base 11, two side portions 12, a top board 13, and two catching pieces 14. The two side portions 12 are respectively set on the left side and the right side of the base 11. The top board 13 stretches across the base 11 and is connected with the top board of the two side portions 12. A first receiving space 113 is form by the top side of the base 11, the inside walls of the two side portions 12 and the bottom of the top board 13, and the first receiving space 113 is used to receive the inner flexible plug 20 and the plurality of electrical connecting terminals 70.

A plurality of terminal grooves 111 are defined at the front top side of the base 11, and a plurality of separating walls 112 each is formed between two adjacent terminal grooves 111. The plurality of terminal grooves 111 are used to be inserted with the plurality of electrical connecting terminals 70, and ends of the plurality of electrical connecting terminals 70 are bared in the first receiving space 113 to connect with an end of the flexible cable 30. Two through holes 114 are defined in the middle segment of the top side of the base 11, and the through holes 114 are adjacent to the side portion 12 and extend through the base 11. The limiting concave holes 115 are defined on the back end of the base 11. A plurality of holes 116 extend through the back end of the base 11.

Guiding portions 121 are respectively protruded forwards from the front ends of the side portions 12, and the front ends of the guiding portions 121 respectively form chamfered portions 122. The side portions 12 respectively extend outwards to form catching pieces 14. Each catching piece 14 includes an extending portion 141, a pressing portion 142, and a resisting portion 143. The front side of the extending portion 141 connects with the side of the side portion 12. The pressing portion 142 is a protrusion which extends outwards from the back end of the extending portion 141. The front end of the pressing portion 142 extends towards the corresponding side portion 12 to form the resisting portion 143.

A second receiving space 123 is formed between each catching piece 14 and the corresponding side portion 12 to receive a corresponding hook portion 40. A bending board extends from each side portion 12 in the second receiving space 123 to form a groove 124, and the groove 124 extends into the guiding portion 121 protruding from the front end of the side portion 12 and extends through the catching piece 14. An open 125 is defined on the side wall of the guiding portion 121, corresponding to the groove 124, that is, the open 125 is connected with the groove 124. The second receiving space 123 is used to receive a corresponding hook portion 40, wherein an end of the hook portion 40 is embedded in the groove 124, and the other end of the hook portion 40 stretches out of the open 125.

A blocking slot 126 is defined in the back end of the inside wall of the side portion 12 and extends from the top side of the side portion 12 to the top side of the base 11. A limiting protrusion 127 is defined in the middle segment of the inside wall of the side portion 12 to fix the inner flexible plug 20. A catching slot 128 is defined on the front end of the inside wall of the side portion 12 and extends through the base 11. A plurality of limiting holes 129 are defined in the top side of the side portion 12.

Figure 3:
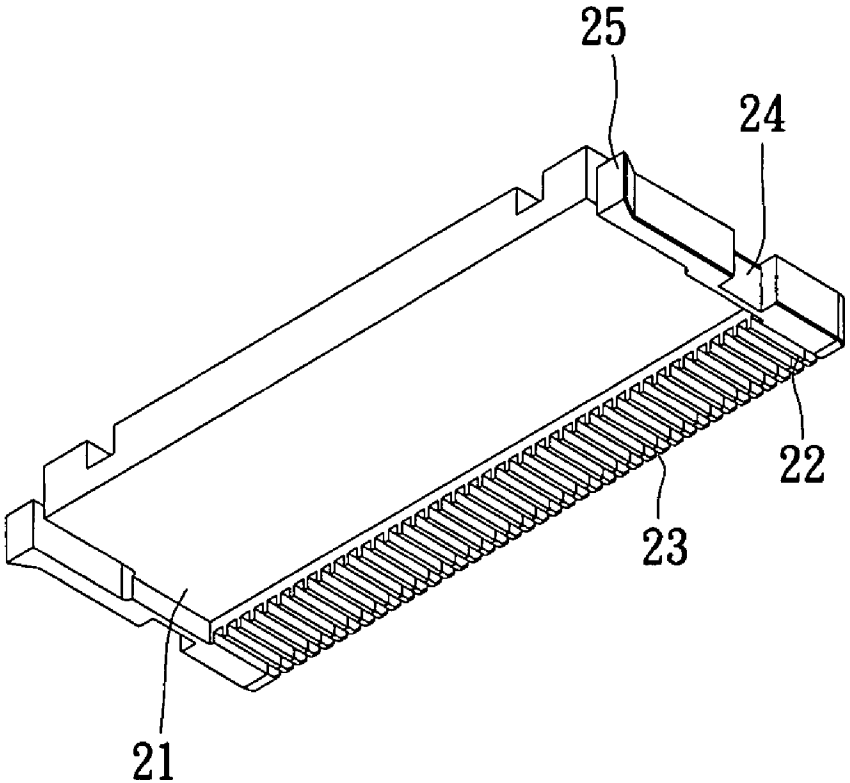
FIG. 3 is a perspective view showing an inner flexible plug according to the present invention.

Please refer to FIG. 3, a plurality of cable slots 21 are defined on the bottom of the inner flexible plug 20 to receive the flexible cable 30. A plurality of separating ribs 22 are defined on the front end of the inner flexible plug 20, the separating ribs 22 bend and extend from the top side of the inner flexible plug 20 to the front end of the cable slots 21 set on the bottom of the inner flexible plug 20. A plurality of receiving slots 23 are separated by the separating ribs 22 correspondingly to the terminal grooves 111 of the base 11. Snap fit portions 24 are respectively defined on the left wall and the right wall of the inner flexible plug 20. The side wall of the inner flexible plug 20 which is adjacent to the snap fit portion 24 extends outwards to form a blocking piece 25, and thereby being fixed in the blocking slot 126 of the insulating body 10. A block wall 26 is defined on the back end of the top side of the inner flexible plug 20. A plurality of limiting slots 27 are separated by the block walls 26.

Figure 4:
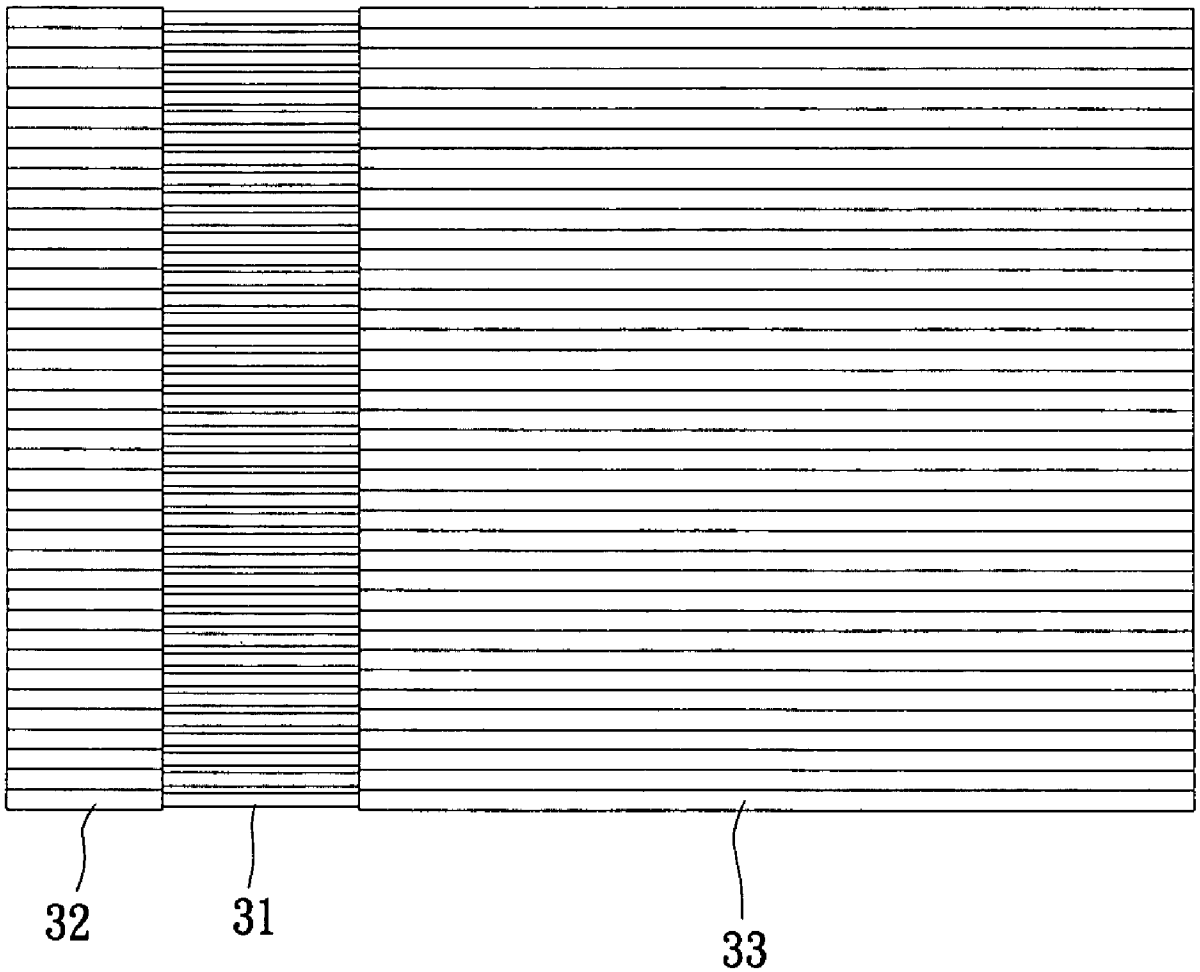
FIG. 4 is a top view showing a flexible cable according to the present invention.
Figure 5:
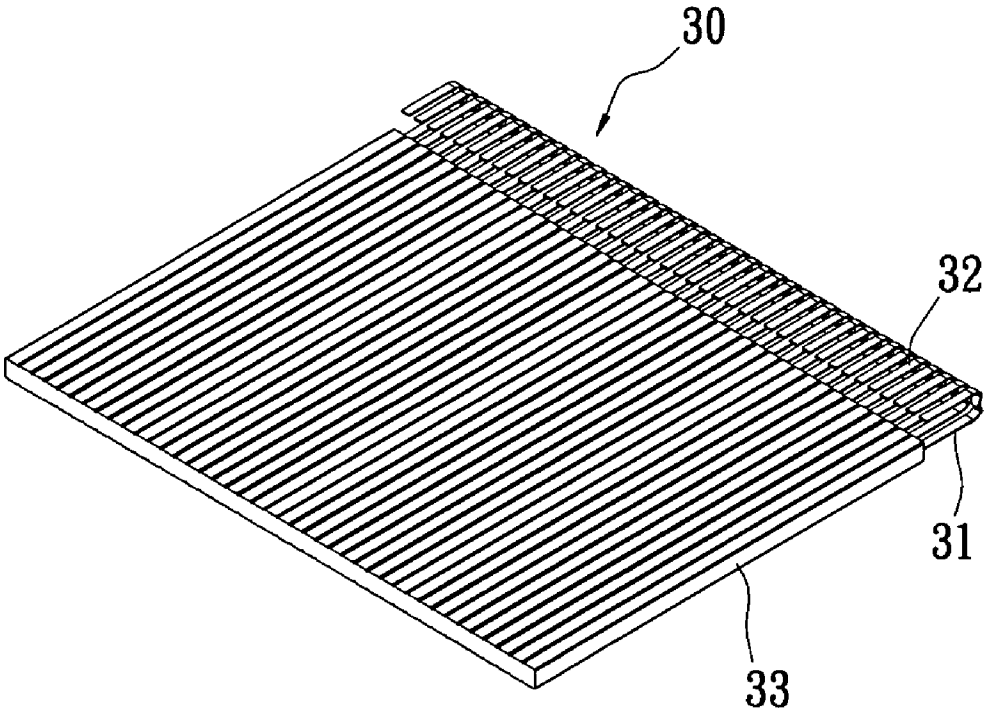
FIG. 5 is a perspective view showing the flexible cable according to the present invention.

Please refer to FIG. 4 and FIG. 5 corporately, the flexible cable 30 includes different segments with different thickness, such as a curve segment 31, a contacting segment 32, and a cable segment 33. The insulating sheath of the middle segment of the flexible cable 30 is removed to bare a plurality of metal conducting wires to form the curve segment 31. The insulating sheath of the metal conducting wires on the fore segment isn't removed, and the fore segment is the contacting segment 32, the insulating sheath of the contacting segment 32 is removed by the bottom side of the top board 13 of the insulating body 10 pushing thereto, and thereby connecting electrically with an end of the electrical connecting terminals 70. The remained metal conducting wires with the insulating sheath form the cable segment 33, which is received in the cable slots 21 of the inner flexible plug 20.

The hook portion 40 includes an inserting portion 41 and a connecting portion 42. The back end of the hook portion 40 is curved to form the inserting portion 41, and the front end of the hook portion 40 defines the connecting portion 42. The connecting portion 42 is a hook and fixes the electrical connector 1 with another pair of connectors (not shown) by the resisting portion 143 of the catching piece 14 pressing against the hook portion 40. The hook portion 40 is received in the second receiving space 123, and the inserting portion 41 is embedded inside the groove 124, and the connecting portion 42 is stretched from the open 125 of the guiding portion 121.

Figure 6B:
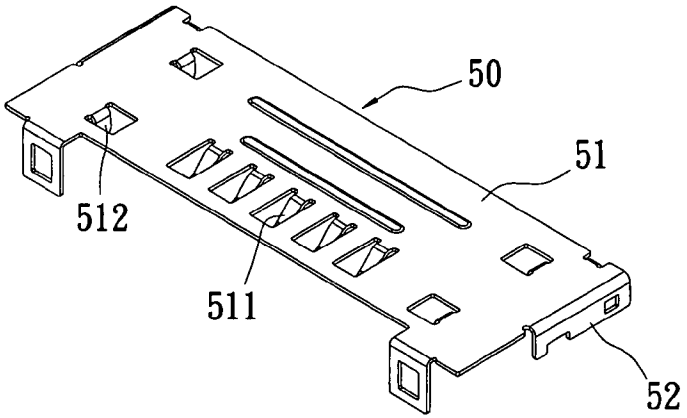
FIG. 6B is a perspective view showing the first metal housing according to the present invention.
Figure 6C:
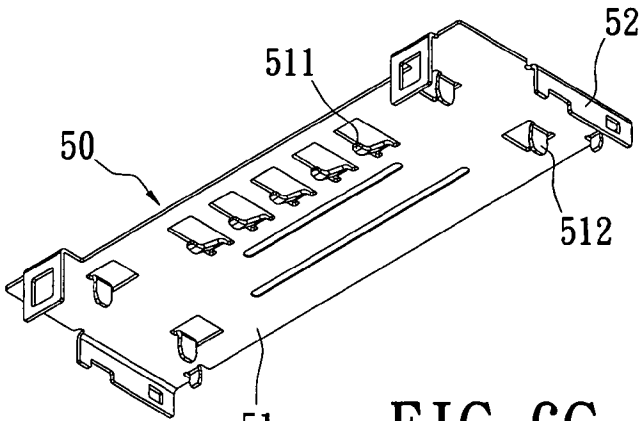
FIG. 6C is another perspective view showing the first metal housing according to the present invention.
Figure 6A:
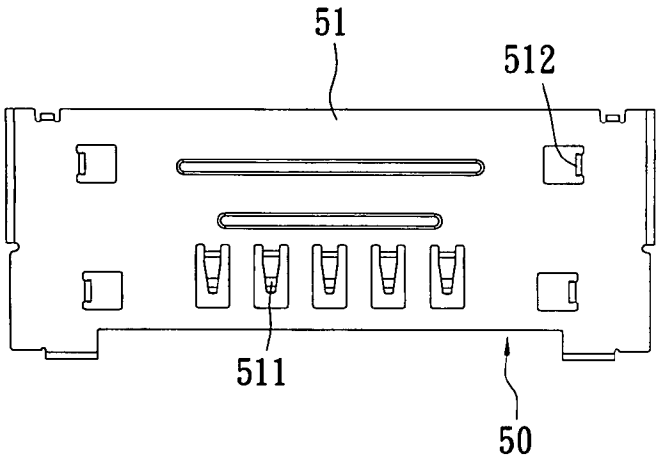
FIG. 6A is a top view showing a first metal housing according to the present invention.

Please refer to FIGS. 6A-6C corporately, the first metal housing 50 includes a top board 51 and two side boards 52 formed by the two sides of the top board 51 curving downwards. The top board 51 extends downwards to form a plurality of first elastic pieces 511 and a plurality of limiting boards 512, wherein the plurality of first elastic pieces 511 correspond to the plurality of limiting slots 27 of the inner flexible plug 20, and the plurality of limiting boards 512 correspond to the plurality of limiting holes 129 of the two side portions 12.

The second metal housing 60 includes a base board 61, a resisting board 62 and two side boards 63. The base board 61 curves upwards to form the two side boards 63, and the front end of the base board 61 protrudes to form the resisting board 62. Two catching portions 621 are defined at the two sides of the resisting board 62 to correspond to the catching slot 128 of the two side portions 12. The base board 61 extends upwards to form a plurality of second elastic pieces 611, two fixing boards 612, and two undercuts 613, wherein the plurality of second elastic pieces 611 correspond to the plurality of holes 116 of the base 11, and the two fixing boards 612 correspond to the limiting concave holes 115 of the base 11, and the two undercuts 613 correspond to the through holes 114 of the base 11.

An end of the electrical connecting terminal 70 curves to form a resisting portion 71, and the resisting portion 71 electrically connects with the contacting segment 32 of the flexible cable 30.

Figure 8:
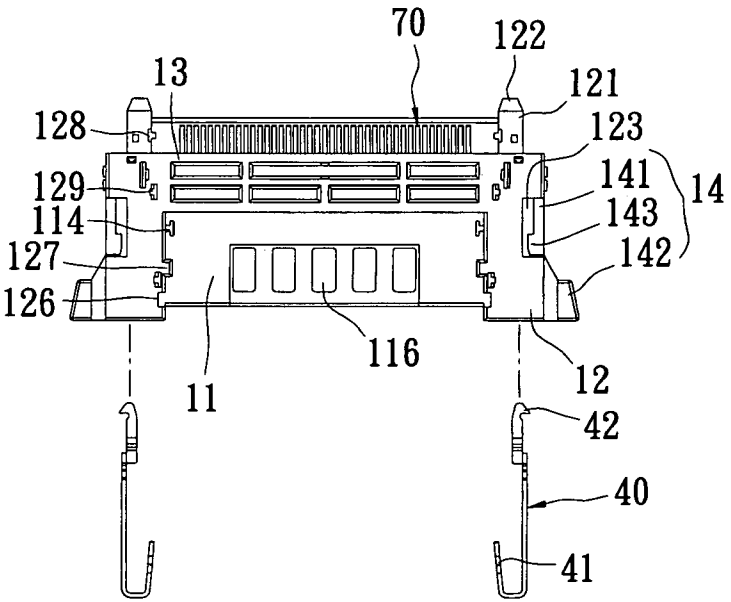
FIG. 8 is an assembled view of the insulating body and a hook portion according to the present invention.
Figure 7:
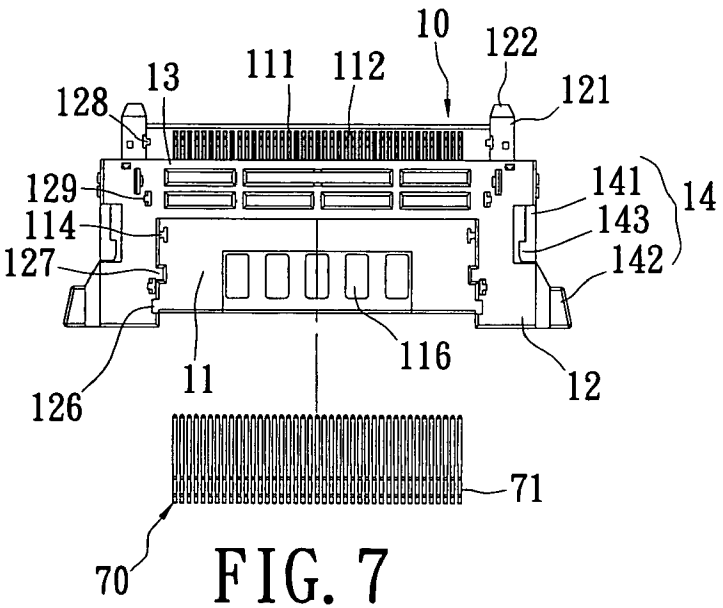
FIG. 7 is an assembled view of the insulating body and electrical connecting terminals according to the present invention.

Please refer to FIG. 7 and FIG. 8 corporately, in assembly, the plurality of electrical connecting terminals 70 are set in the plurality of terminal grooves 111 of the base 11, and the resisting portions 71 of the plurality of electrical connecting terminals 70 bare in the first receiving space 113 after the plurality of electrical connecting terminals 70 are pushed onto their fixed location. The hook 40 are set in the second receiving space 123, wherein the inserting portion 41 defined on the back end of the hook 40 is embedded in the groove 124, and the connecting portion 42 defined on the front end of hook 40 stretches from the open 125 of the guiding portion 121.

Figure 9A:
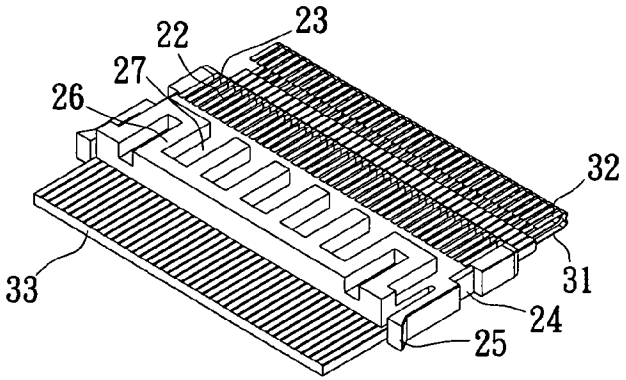
FIG. 9A is an assembled view of the inner flexible plug and the flexible cable according to the present invention.
Figure 9B:
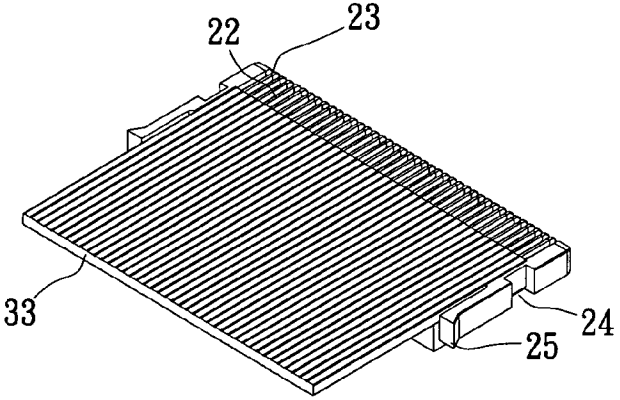
FIG. 9B is an assembled view of the inner flexible plug and the flexible cable according to the present invention, at another angle.

Please refer to FIG. 9A and FIG. 9B corporately, the cable segment 33 of the flexible cable 30 is received in the cable slot 21 of the inner flexible plug 20. The curve segment 31 extends into the receiving slot 23 set on the bottom side of the inner flexible plug 20 and curves into the receiving slot 23 set on the top side of the inner flexible plug 20, and thereby making the contacting segment 32 locate on the top side of the inner flexible plug 20.

Figure 10:
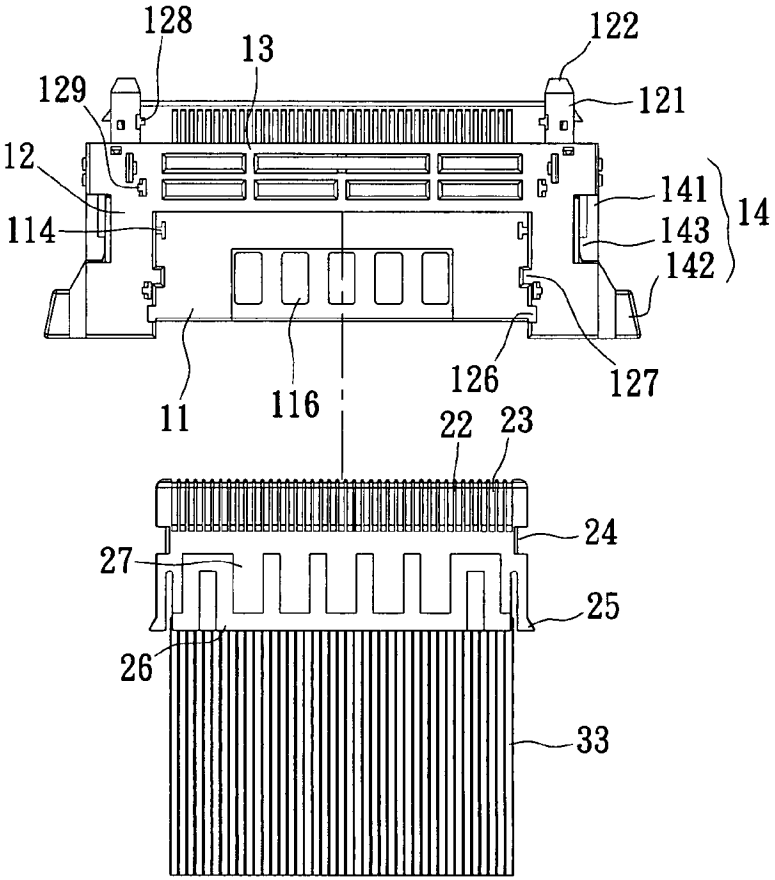
FIG. 10 is an assembled view of the insulating body and the flexible cable according to the present invention.

Please refer to FIG. 10, the inner flexible plug 20 is pushed into the first receiving space 113 of the insulating body 10 to make the blocking piece 25 of the inner flexible plug 20 be integrated and fixed in the blocking slot 126 of the insulating body 10, and the blocking piece 25 is retained in the inner flexible plug 20 by the limiting protrusion 127 of the insulating body 10 to make the inner flexible plug 20 closely engage with the insulating body 10.

When being pushed, the insulating sheath of the contacting segment 32 of the flexible cable 30 is removed by the bottom of the top board 13 of the insulating body 10 to bare a plurality of metal conducting wires, and the contacting segment 32 is pressed into the receiving slot 23 of the inner flexible plug 20.

Figure 11:
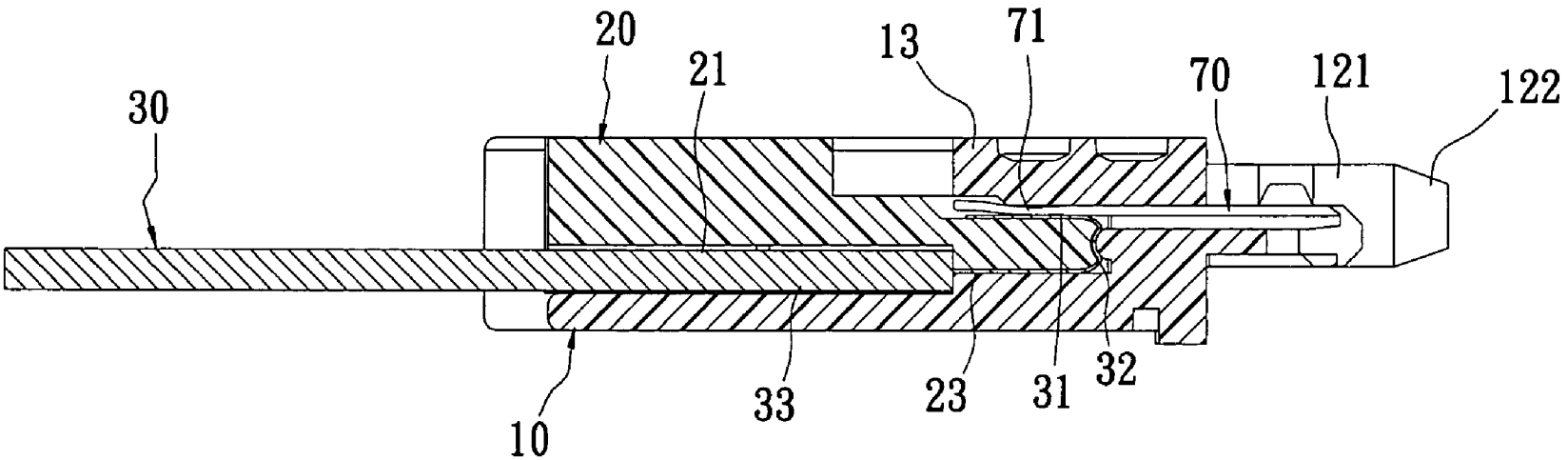
FIG. 11 is a cross-sectional view of the insulating body and the inner flexible plug according to the present invention.

Please refer to FIG. 11, because the resisting portions 71 of the plurality of electrical connecting terminals 70 are bared in the first receiving space 113, and the receiving slot 23 of the inner flexible plug 20 corresponds to the terminal grooves 111 of the base 11, so the resisting portions 71 of the plurality of electrical connecting terminals 70 can extend into the receiving slot 23 of the inner flexible plug 20 and connect with the contacting segment 32 of the flexible cable 30, without any location aiming, and thereby making the contacting segment 32 electrically connect with the resisting portions 71 of the plurality of electrical connecting terminals 70.

Figure 12B:
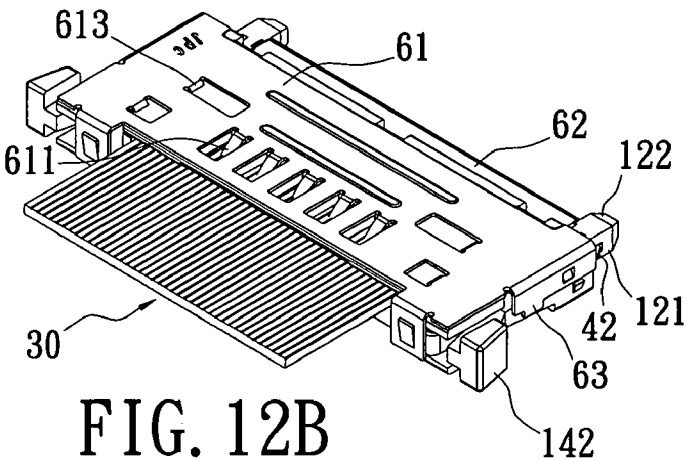
FIG. 12B is an assembled view of the insulating body and the second metal housing according to the present invention, at another angle.
Figure 12C:
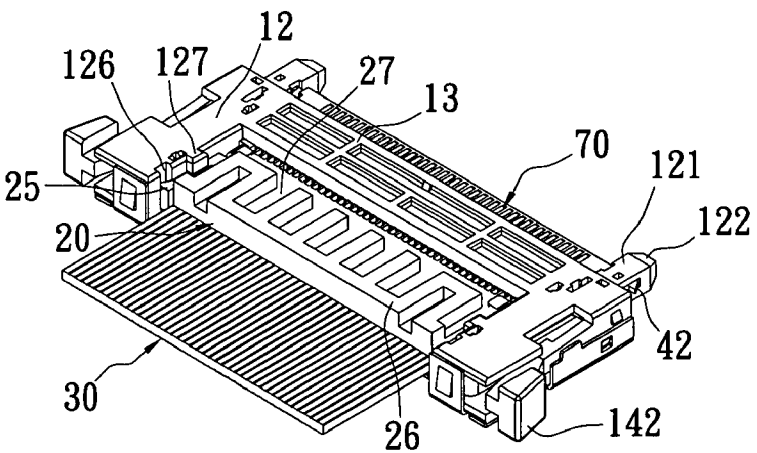
FIG. 12C is an assembled view of the insulating body and the second metal housing according to the present invention, at another angle.
Figure 12A:
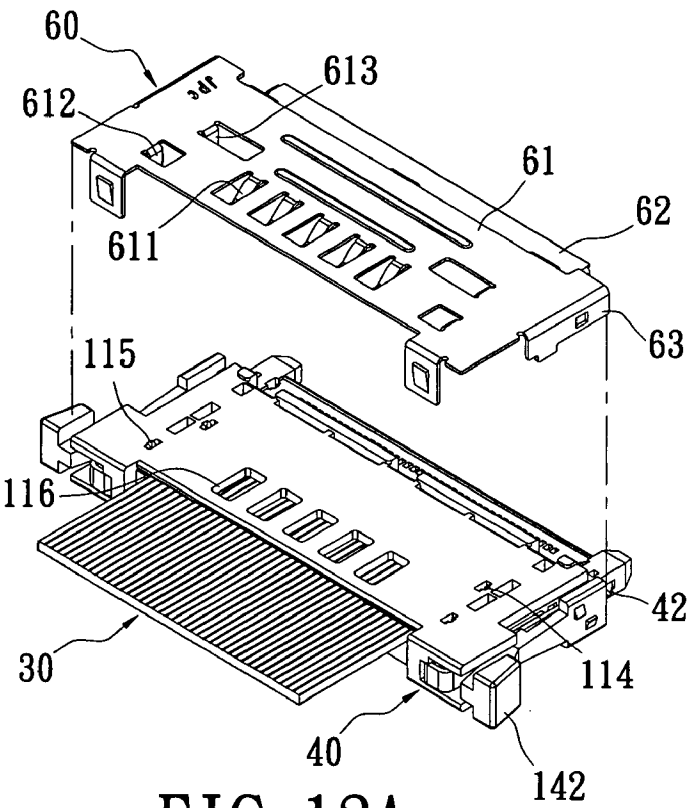
FIG. 12A is an assembled view of the insulating body and a second metal housing according to the present invention.

Please refer to FIGS. 12A-12C corporately, the second metal housing 60 is connected with the bottom side of the insulating body 10, the plurality of second elastic pieces 611 of the second metal housing 60 extend into the plurality of holes 116 of the insulating body 10 and resist against the flexible cable 30 inside the cable slot 21 to fix the flexible cable 30. The two fixing boards 612 joint in the limiting concave holes 115 on the bottom side of the insulating body 10. The two undercuts 613 extend into the through holes 114 of the insulating body 10 and snap in the snap fit portion 24 of the inner flexible plug 20, and thereby making the undercut 613 press the inner flexible plug 20 in a stable manner. The resisting board 62 resist against the front end of the base 11, and the catching portion 621 engages in the catching slot 128, and thereby connecting the second metal housing 60 to the insulating body 10 in a stable manner.

Figure 13B:
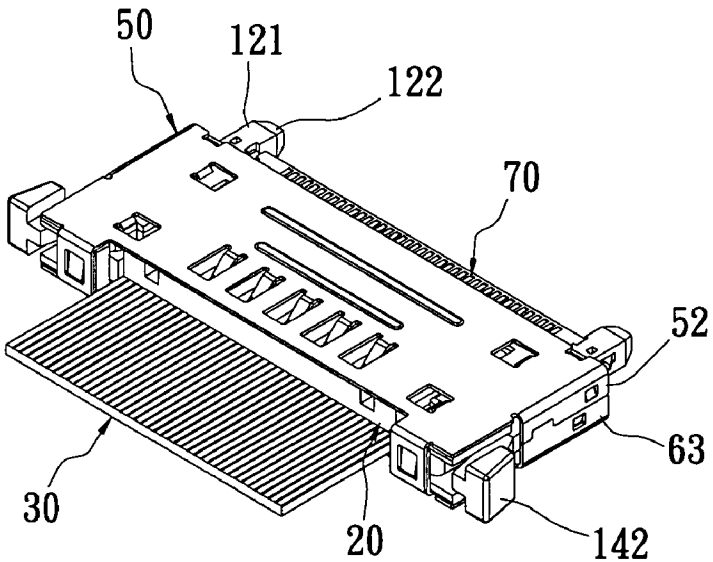
FIG. 13B is an assembled view of the insulating body and the first metal housing according to the present invention, at another angle.
Figure 13A:
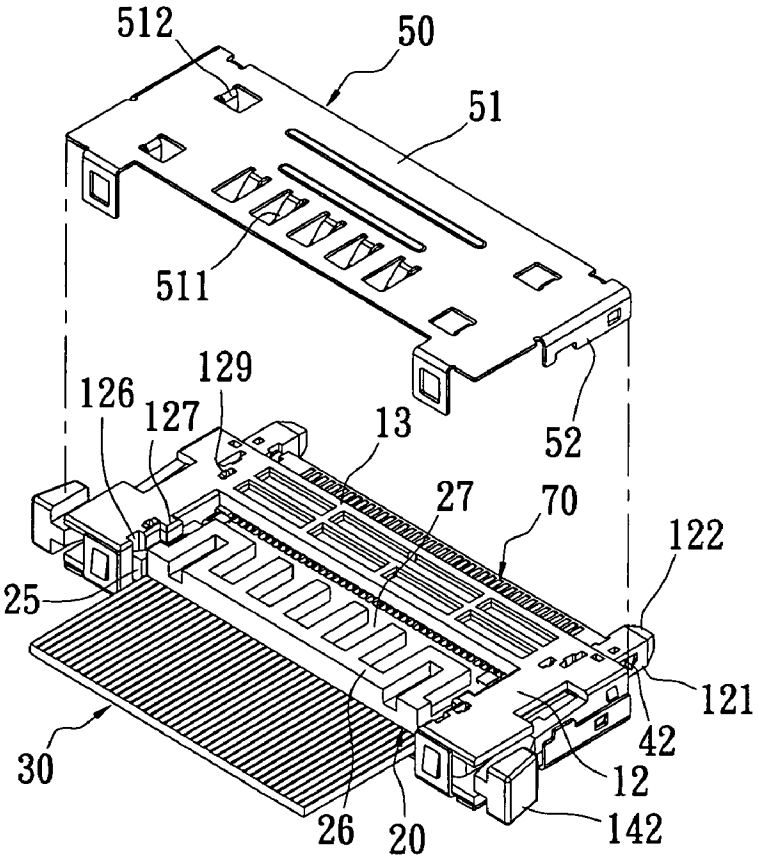
FIG. 13A is an assembled view of the insulating body and the first metal housing according to the present invention.

Please refer to FIG. 13A and FIG. 13B corporately, finally, the first metal housing 50 is connected with the top side of the insulating body 10, the plurality of first elastic pieces 511 of the first metal housing 50 resist against the limiting slots 27 of the inner flexible plug 20 to press the inner flexible plug 20 in a stable manner. The plurality of limiting boards 512 are engaged in the plurality of limiting holes 129 of the top side of the insulating body 10 to prevent the first metal housing 50 from moving and ensure the connection of the first metal housing 50 and the insulating body 10.

Therefore, the features and the functions of the electrical connector of the present invention are:

1. The flexible cable 30 and the electrical connecting terminals 70 are accurately located by the inner flexible plug 20, thereby some pitch is retained, the work time is shortened, and the yield rate is increased.
2. The flexible cable 30 and the electrical connecting terminals 70 are closely engaged by the receiving slot 23 of the inner flexible plug 20, so weld processes are omitted, the process is simplified, and the work time is shortened.
3. The flexible cable 30 is closely jointed by the force between the inner flexible plug 20 and the insulating body 10, the problem of the asymmetric force and the cases of miss locating or inclining which make the circuitry badly contact and short circuit can be avoided.
4. The insulating sheath of the flexible cable 30 can be removed basing on the structure design of the insulating body 10, thus, it needn't be removed by manual work.
5. The flexible cable 30 is tightly pressed in the insulating body 10 by the inner flexible plug 20 to enhance the stability of the flexible cable, thus, it doesn't need to adhere an additional strength board on the flexible cable 30.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An electrical connector, comprising:

an insulating body, comprising a base, two side portions and a top board, said side portions set on two opposite sides of said base respectively, said top board connected between said two side portions, and a plurality of terminal grooves defined in a front end of said base;

an inner flexible plug, having a top side and a bottom side, located in said insulating body and having a plurality of receiving slots corresponding to said terminal grooves, wherein said plurality of receiving slots are respectively separated by a plurality of separating ribs, and said plurality of separating ribs and said receiving slots extend from the top side of said inner flexible plug to its bottom side in a bent way;

a metal housing, covering a bottom side of said insulating body; and a flexible cable, set between said insulating body and said inner flexible plug, wherein a curving segment is defined on a middle segment of said flexible cable and set in said plurality of receiving slots.

2. The electrical connector according to claim 1, wherein a plurality of separating walls each is formed between two adjacent terminal grooves.

3. The electrical connector according to claim 1, wherein a top side of said base and two inside walls of said two side portions and a bottom side of said top board define a first receiving space, and said inner flexible plug is combined in said first receiving space.

4. The electrical connector according to claim 1, wherein each side portion has a chamfered portion at its front end.

5. The electrical connector according to claim 1, wherein each side portion has a catching piece, and said catching portion defines an extending portion, a pressing portion and a resisting portion, said extending portion is connected with a side of said side portion, said pressing portion is a protrusion extending outwards from a back end of said extending portion, and a front end of said pressing portion extends towards said side portion to form said resisting portion.

6. The electrical connector according to claim 5, wherein a second receiving space is formed between said catching piece and said side portion to receive two hook portions.

7. The electrical connector according to claim 1, wherein said curved segment is a plurality of bare metal conducting wire being removed insulating sheaths, and said curved segment extends into said receiving slots in said bottom side of said inner flexible plug and is bent into said receiving slots in said top side of the inner flexible plug.

8. The electrical connector according to claim 1, wherein a cable slot is defined in said bottom side of said inner flexible plug, said flexible cable is set in said cable slot.

9. The electrical connector according to claim 8, wherein said flexible cable has a contacting segment and a cable segment, said contacting segment is set in said receiving slot and is electrically connected with a plurality of electrical connecting terminals, and said cable segment is set in said cable slot.

10. The electrical connector according to claim 1, further comprising another metal housing which covers a top of said insulating body.

* * * * *